United States Patent [19]

Ho

[11] Patent Number: 4,784,586

[45] Date of Patent: Nov. 15, 1988

[54] TURBOCHARGER HAVING CONTROLLED HEAT TRANSFER FOR BEARING PROTECTION

[75] Inventor: I-Chung Ho, Rancho Palos Verdes, Calif.

[73] Assignee: Allied-Signal Inc., Morristown, N.J.

[21] Appl. No.: 919,748

[22] Filed: Oct. 16, 1986

[51] Int. Cl.[4] ..... F04B 17/00

[52] U.S. Cl. ..... 417/114; 415/114

[58] Field of Search ..... 417/405, 406, 407; 60/602; 165/47 A, DIG. 4; 415/114

[56] References Cited

U.S. PATENT DOCUMENTS

Re. 30,333 7/1980 Gordon, Jr. et al. ..... 417/407

3,754,398 8/1973 Mattavi ..... 165/DIG. 4

4,717,318 1/1988 Elpern ..... 417/407

FOREIGN PATENT DOCUMENTS 45722 3/1985 Japan ..... 417/407

*Primary Examiner*—Louis J. Casaregola

*Assistant Examiner*—Timothy S. Thorpe

*Attorney, Agent, or Firm*—Ken C. Decker

[57] ABSTRACT

A turbocharger which by the configuration of a center housing portion thereof reduces heat transfer from a turbine housing portion to a turbine-end bearing in order to reduce oil coking in the latter. A phase-change material is included in the center housing portion. Control of lubricant flow further aids in reduction of oil coking in the turbocharger.

22 Claims, 3 Drawing Sheets

TURBOCHARGER HAVING CONTROLLED HEAT TRANSFER FOR BEARING PROTECTION

BACKGROUND OF THE INVENTION

The field of this invention is turbochargers of the type used to provide pressurized combustion air to an internal combustion engine. Particulary, this invention relates to a turbocharger including a housing journaling an elongate shaft for rotation with a turbine and a compressor. The turbine and compressor are spaced apart at opposite ends of the shaft, and the housing defines a closed void substantially surrounding the shaft. A quantity of material having selected heat transfer and heat absorptive qualities is captively disposed within the closed void for controlling the temperature of both the shaft and housing bearings following engine shutdown.

More particularly, the housing defines a tortuous singular path by which heat may be conductively transferred from the turbine section of the turbocharger to the shaft bearing, or portion thereof, disposed closest to the turbine section. Consequently, substantially all conductively transferred heat reaching the turbine end bearing via the material of the housing must initially axially bypass the turbine end bearing, and then be conducted radially inwardly and axially toward the bearing in a direction toward the turbine section. The quantity of selected material in the housing void is disposed in the singular heat transfer path in heat transfer parallel with the housing material local to the bearing. The selected material is highly absorptive of heat energy at temperatures above the normal operating temperature of the turbocharger.

Turbochargers in general are well known in the pertinent art for supplying pressurized combustion air to an internal combustion Otto or Diesel cycle engine. Historically, turbochargers have been used on large engines for stationary or heavy automotive agricultural or construction vehicle applications. These turbochargers generally include a housing including a turbine housing section for directing exhaust gasses from an exhaust inlet to an exhaust outlet across a rotatable turbine. The turbine rotor drives a shaft journaled in the housing. A compressor rotor is driven by the shaft and is spaced from the turbine housing section. A compressor housing section receives the compressor rotor and defines an air inlet for inducting ambient air and an air outlet for delivering the pressurized air to an inlet manifold of the engine.

Because these past turbocharger applications involved relatively low specific engine power outputs with relatively low exhaust gas temperatures and infrequent engine shutdowns no special precautions were necessary to cool the shaft and the bearings journaling the shaft. Experience showed that the usual engine pressure oil flow lubrication which was necessary during turbocharger operation also by its cooling effect maintained the shaft and bearings at a temperature low enough to prevent oil coking in the turbocharger after engine shutdown. Because the operating temperature of the hot turbine end of the turbocharger was low enough and the mass of the turbocharger relatively large, the highest temerature experienced at the shaft and bearings after the oil flow was stopped was not high enough to degrade or coke the oil remaining in the turbocharger after engine shutdown.

However, passenger car automotive turbocharger applications have brought to light many problems. The specific engine outputs are usually higher leading to higher exhaust gas temperatures. The turbocharger itself is considerably smaller than its heavy equipment predecessor so that a smaller thermal mass is available to dissipate residual heat from the turbine housing section and turbine after engine shutdown. The result has been that heat soaking from the turbine housing section and turbine into the shaft and remainder of the turbocharger housing raise the temperature high enough to degrade or coke the remaining oil in the housing after engine shutdown. Of course, this coked oil may plug the bearings so that subsequent oil flow lubrication and cooling is inhibited. This process soon leads to bearing failure in the turbocharger.

An interim and incomplete solution to the above problem was provided by the inclusion of a hydraulic accumulator with a check and metering valve in the oil supply conduit between the engine and turbocharger. During engine operation this accumulator filled with pressurized oil. Upon engine shutdown the oil was allowed to flow only to the turbocharger at a controlled rate to provide bearing and shaft cooling while the remainder of the turbocharger cooled down. However, automotive passenger vehicles allow only sufficient space for an accumulator which is of insufficient size to dissipate the residual heat of conventional turbochargers. Under these conditions failure of the turbocharger may be accelerated.

Another more recent and more successful solution to the above problem has been the provision of a liquid cooling jacket in a part of the turbocharger housing adjacent to the turbine housing section. Liquid engine coolant is circulated through the jacket during engine operation by the cooling system of the engine so that the turbocharger temperature is relatively low. Additionally, following engine shutdown the coolant remaining in the jacket provides a heat sink so that residual heat from the turbine housing section does not increase the shaft and bearing temperatures to undesirably high levels. U.S. Pat. No. 4,068,612 to E. R. Meiners, and U.S. Pat. No. Re. 30,333 of P. B. Gordon, Jr. et al, illustrate examples of this conventional solution to the problem.

However, this latter class of turbochargers all require that engine coolant be piped to and from the turbocharger. This is usually accomplished with flexible hoses which complicate and increase the cost of the original installation of the turbocharger. Also, such plumbing requires additional maintenance and may be subject to coolant leakage which could disable the vehicle.

SUMMARY OF THE INVENTION

In view of the above, it is an object for the present invention to provide a method of limiting the temperature at the shaft and bearings of a turbocharger following engine shutdown without the use of liquid engine coolant and the attendant plumbing that such coolant use involves.

A further object is to provide a turbocharger which, except for the necessary air, exhaust gas, and lubricating oil connections with the engine, is a unit unto itself and is not reliant upon the cooling system of the engine to prevent overtemperature conditions within the turbocharger.

The present invention provides the method of controlling the heat transfer within a turbocharger following engine shutdowns by providing a captive mass of heat absorptive material which during turbocharger operation exists in relatively low energy molecular state and which upon engine shutdown and the attendant cessation of cooling oil flow absorbs residual heat from the turbocharger turbine housing section with an attendant phase change.

The above-described captive mass of material is further disposed in an inventively novel housing structure provided in accord with this disclosure. The housing structure effectively isolates the turbine end shaft bearing from heat conducted via the housing material in a single axial direction. That is, the housing conducts heat to the turbine end bearing only via a horse shoe or U-shaped heat transfer path having two axially-extending legs. This tortuously long heat transfer path helps in lowering temperatures experienced at the turbine end bearing during hot soak following engine shut down.

At least one leg of the described U-shaped heat transfer path is composed of material of the housing and material of the captive mass in heat transfer parallelism. Preferably, this one leg is the one closest to the turbine end bearing. Consequently, the heat absorptive nature of the captive mass both reduces the quantity of heat which may be further conducted toward the turbine end bearing, as well as decreasing the driving force (temperature difference) tending to drive heat by conduction through the housing-defined side of this heat transfer leg penultimate to the turbine end bearing.

The present invention provides turbocharger apparatus comprising a center housing for spacing apart respective compressor housing and turbine housing portions, and journaling an elongate shaft extending between the housing portions. A compressor rotor and a turbine rotor are each drivingly connected to the shaft at opposite ends thereof and rotatable within respective ones of the housing portions. An axially elongate bearing carried by the center housing proximate to the turbine housing portion rotatably supports the shaft. The shaft defines a first conductive heat transfer path extending from the turbine rotor to the bearing. The housing includes structure for defining a singular second conductive heat transfer path extending from the turbine housing portion to the bearing. This second heat transfer path at a transverse radial plane disposed axially within the axial dimension of the bearing includes a first radially outer annular leg wherein conductive heat transfer extends axially from the turbine housing portion through the radial plane, and a second radially inner annular leg wherein conductive heat transfer extends axially from said radial plane toward the turbine housing portion and the bearing. This second leg is defined in part by a material selected to undergo a molecular change of phase at a determined temperature with attendant absorption of heat.

BRIEF DESCRIPTION OF THE DRAWINGS

FIG. 4 is a fragmentary cross-sectional view taken along line 4—4 of FIG. 1; and FIG. 5 schematically depicts a conductive heat transfer circuit within the turbocharger of the invention.

DETAILED DESCRIPTION OF THE PREFERRED EMBODIMENT

Figure 1:
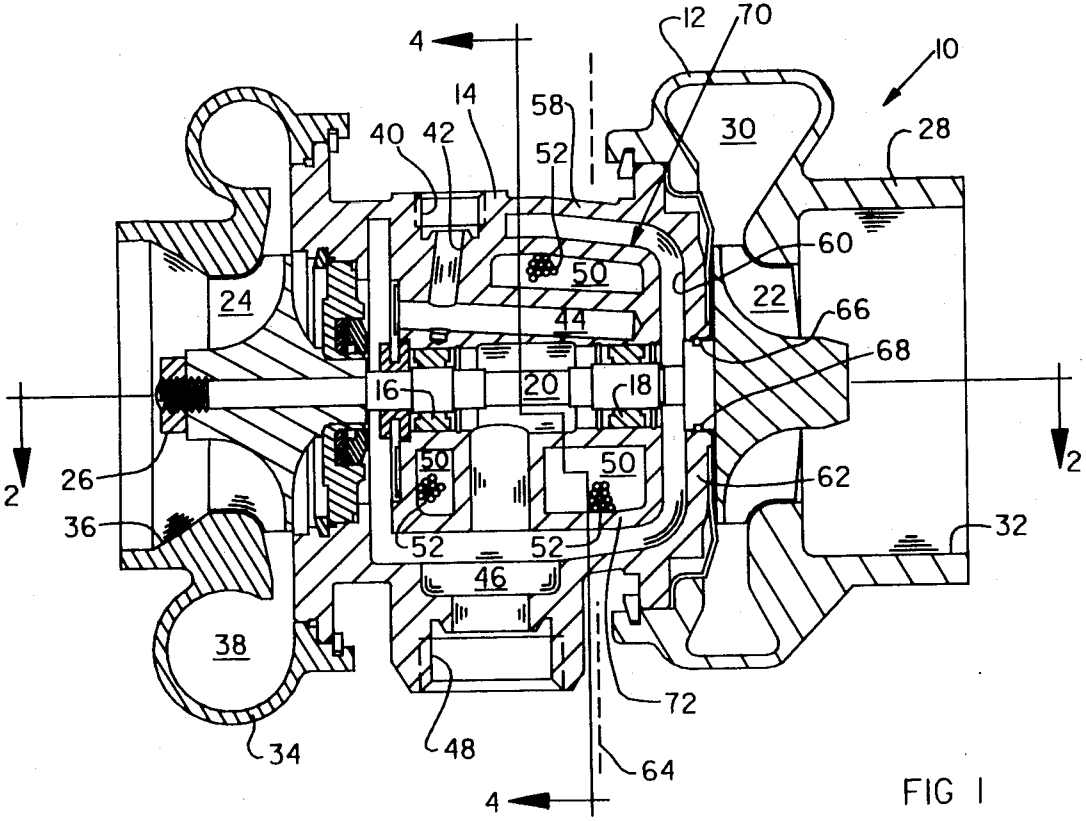
FIG. 1 is a longitudinal view partly in cross-section of a turbocharger embodying the present invention.
Figure 1A:
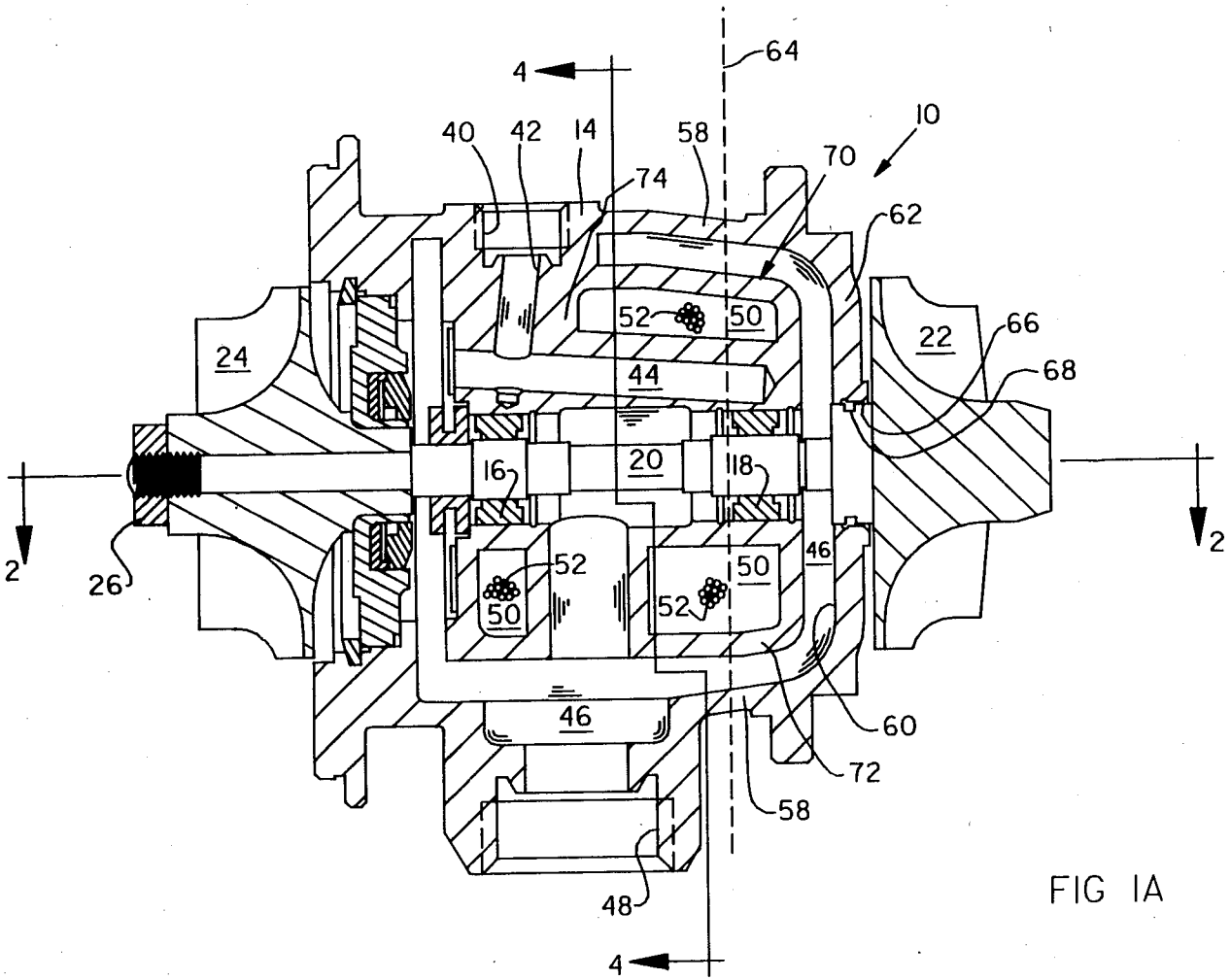
FIG. 1A is an enlarged view of a portion of FIG. 1 having parts thereof omitted for clarity of illustration.

With reference to FIG. 1, a turbocharger 10 includes a housing generally referenced with the numeral 12. Housing 12 includes a center section 14 receiving a pair of spaced apart journal bearings 16, 18, and rotatably receiving therein an elongate shaft 20. A turbine wheel 22 is attached to or integrally formed with one end of shaft 20. At the opposite end of shaft 20 a compressor wheel 24 is carried thereon and drivingly secured thereto by a nut 26 threadably engaging the shaft.

A turbine housing section 28 mates with the center section 14 and defines an exhaust gas inlet 30 leading to a radially outer portion of the turbine wheel 22. The turbine housing section also defines an exhaust gas outlet 32 leading from the turbine wheel 22. Similarly, a compressor housing section 34 mates with the housing center section 14 at the end thereof opposite the turbine housing section 28. The compressor housing section 34 defines an air inlet 36 leading to the compressor wheel 24, and an air outlet (not shown) opening from a diffuser chamber 38.

The turbocharger center section 14 also defines an oil inlet 40 leading to the bearings 16, 18 via passages 42, 44, and an oil drain gallery 46 leading from the bearings to an oil outlet 48. Also defined within the housing center section 14 is a closed cavity 50 the shape of which is best understood by viewing FIGS. 1–4 in conjunction. The cavity 50 extends axially between the compressor housing section 34 and turbine housing section 28 of the housing 14. Cavity 50 also extends circumferentially over the top and down each side and under the shaft 20, viewing FIG. 4. Thus, it can be envisioned that cavity 50 envelopes the shaft 20, and particularly bearing 18.

Disposed within the cavity 50 is a predetermined quantity of a material 52 selected with a view to, among other factors, its heat transfer coefficient, its chemical stability under thermal cycling, its cost, and its heat of fusion or other change of phase heat capacity. Also of particular importance with respect to the material 52 is the temperature at which such change of phase heat absorption and heat release takes place.

Figure 2:
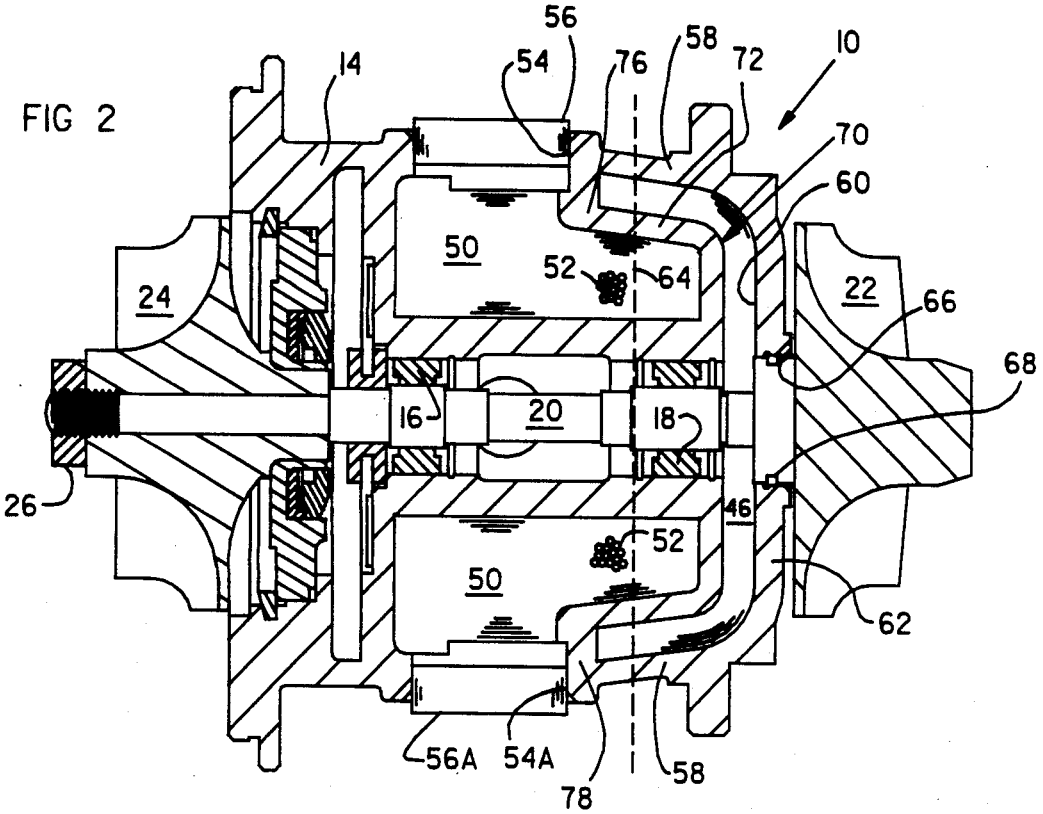
FIG. 2 is a fragmentary cross-sectional view taken along line 2—2 of FIG. 1.

During manufacturing of the turbocharger 10, the material 52 is loaded into the cavity 50 preferably in a solid pellet or granular form via a port 54, 54A opening thereto, viewing FIG. 2. After the cavity 50 is substantially filled with material 52, the ports 54, 54A are permanently closed by plugs 56, 56A which threadably engage the housing center section 14. By way of example only, the plugs 56, 56A may be removably secured to housing section 14 by an anerobic adhesive, or my be permanently secured thereto as by welding. In either case, the plugs 56, 56A are intended to permanently close the ports 54, 54A so that the cavity 50 is closed for the service life of the turbocharger 10. Consequently, the material 52 is permanently captured within the cavity 50. It will be noted that because the material 52 is loaded into cavity 50 in the form of pellets or granules, it has been so illustrated in the drawing figures. However, after the first time turbocharger 10 is operated on an engine and following hot shutdown thereof, the material 52 exists in cavity 50 as a fused mass.

Viewing the drawing FIGS. 1–4 once again it will be seen that the center housing section 14 includes a radially outer axially and circumferentially extending wall 58 extending axially between the housing portions 28 and 34. The wall 58 radially outwardly bounds the drain gallery or cavity 46, and defines the inlet port 40 and outlet port 48. Viewing FIGS. 2 and 4, it will be seen that cavity 46 is circumferentially continuous in an axial extent at least from an axially disposed surface 60 of a radially extending wall 62 to a transverse radial plane designated with reference numeral 64. The wall 62 defines an aperture 66 through which the shaft 20 rotatably passes. Shaft 20 carries a resilient ring type of seal 68 engaging the surface of aperture 66 to impede fluid flow between the cavity 46 and the exhaust gas flow path defined by features 22, 30, 32 in combination. The transverse radial plane 64 is disposed axially in radial congruence with the end of bearing 18 which is closest to compressor housing 34. However, viewing FIG. 4 it will be seen that the cavity 46 is circumferentially continuous beyond the plane 64 axially at least to the plane 4—4 at which FIG. 4 is taken, referring to FIG. 1.

Further to the above, it can be seen that the housing section 14 defines a bearing carrier portion 70 substantially coaxial with and spaced radially inwardly of the wall 58. The bearing carrier portion 70 is also spaced axially from the wall 62 to bound the cavity 46. Bearing carrier portion 70 defines the cavity 50 radially outwardly of bearing member 18. The cavity 50 is seen to be axially nested with cavity 46 so that radially outwardly of bearing member 18 the cavity 50 is disposed radially between the bearing 18 and cavity 46. The bearing carrier portion includes an annular wall part 72 which bounds the cavity 50 radially outwardly, and also radially inwardly bounds cavity 46. The wall part 72 is substantially coannular with the wall 58 and coaxial with shaft 50, viewing FIG. 4.

FIGS. 1 and 2 illustrate that the bearing carrier portion 70 is supported within center housing portion 14 by radially extending support sections 74, 76, and 78. The support section 74 in part defines the passage 42 extending from oil inlet port 40 to passage 44 and bearings 16, 18. Support sections 76, 78, respectively, in part define ports 54, 54A, viewing FIG. 2.

Having observed the structure of turbocharger 10, attention may now be directed to its operation. During operation of an internal combustion engine (not shown) associated with turbocharger 10, high temperature and pressure exhaust gasses enter the housing 12 via exhaust gas inlet 30. These exhaust gasses flow from inlet 30 to outlet 32 while expanding to a lower pressure and rotatably driving turbine wheel 22. The turbine wheel 22 drives shaft 20 which also carries compressor wheel 24. Consequently, compressor 24 draws in ambient air via inlet 36 and discharges the same pressurized via an outlet (not shown) communicating outwardly from chamber 38. The exhaust gasses flowing within the turbine section of housing 12 also act as a substantially continuous source of heat which is transferred to housing 12 and turbine wheel 22 so long as the engine and turbocharger 10 are in operation. Consequently during operation of the turbocharger 10, heat is almost continuously conducted from the hot turbine housing section 28 and turbine wheel 22 to the cooler portions of the turbocharger. This heat transfer occurs by conduction along shaft 20 and turbine center housing section 14, leftwardly viewing FIG. 1.

At the same time, a flow of relatively cool lubricating oil is received via inlet 40 and passages 42, 44. This cooling oil flow by its traverse through passages 42, 44, its flow from bearings 16, 18, and its flow across the internal surfaces of oil drain gallery 46 absorbs heat from and cools the turbocharger 10. The turbocharger 10 also liberates heat to its environment by radiation and convection from external surfaces. Also, heat may be transferred to air traversing the compressor wheel 24 and flowing to the air outlet via chamber 38. The summation of these heat transfer effects results in the bearings 16, 18 operating at temperatures low enough to prevent oil coking therein. Further as a consequence, the materil 52 is maintained in a relatively low energy molecular state.

Upon shutdown of the engine supplying exhaust gasses to inlet 30, both the source of heat energy and the source of cooling oil flow to the turbocharger cease to operate. However, both the turbine housing section 28 and turbine wheel 22 are hot and hold a considerable quantity of residual heat. This residual heat is conducted to the cooler parts of the turbocharger much as heat was conducted during operation thereof. However, no cooling oil flow or internal compressor air flow is now present. Consequently, the temperature of shaft 20 and center housing 14 progressively increase for a time over their normal operating temperatures. This temperature increase, if uncontrolled, could result in temperatures at bearings 16, 18, and particularly at the latter, which would degrade or coke the residual oil therein.

With the closer attention now to the heat transfer to bearing 18 by conduction within turbocharger 10, clearly the shaft 20 provides a conductive path directly to bearing 18. However, experience has shown that the relatively low mass and low heat storage capacity of the turbine wheel results in heat conduction via the material of the center housing of conventional turbochargers being the most problematical in causing oil coking in the turbine-end bearing. Consequently, the Applicant believes that oil coking in bearing 18 may be avoided by the present invention despite the direct heat transfer path of shaft 20.

Conductive heat transfer from turbine housing portion 28 to bearing 18 must first proceed leftwardly axially toward the compressor housing portion via annular wall 58. It will be recalled that the bearing carrier portion 70 is supported by support sections 74–78 disposed leftwardly of plane 64. Consequently, heat conducted leftwardly in wall 58 must completely bypass the bearing 18 axially before reaching a radially inwardly extending conductive path. The heat transfer path secondly includes the support section 74–78 extending radially inwardly to bearing carrier portion 70. Thirdly, conductive heat transfer must proceed rightwardly axially toward the turbine housing section and bearing 18 within bearing carrier portion 70.

Recalling that this third part of the conductive heat transfer path in bearing carrier portion 70 includes the material 52, it is apparent that a considerable quantity of heat may be conducted from turbine housing portion 28 with only very little heat reaching bearing 18 via the conductive pathway. In other words, that heat which is conducted radially inwardly to bearing carrier portion 70 via support sections 74–78 will be largely absorbed by phase change of material 52.

The above may be better appreciated by viewing the heat transfer circuit schematically depicted by FIG. 5 wherein the turbine housing 28 may be considered a heat source providing a conductive heat flow via a path (wall 58). The path 58 extends to the relatively cooler heat sink of compressor housing 34. A branch path defined by support sections 74–78 extends to bearing carrier portion 70. Within the bearing carrier portion 70, a heat sink (material 52) lies in the conductive path between support sections 74–78 and bearing 18. The heat transfer path to bearing 18 includes a first leg 58 axially bypassing the bearing 18, a second radially extending leg (74–78), and a third axially extending leg including heat absorptive material 52. That is, the path to bearing 18 is generally U-shaped.

Figure 3:
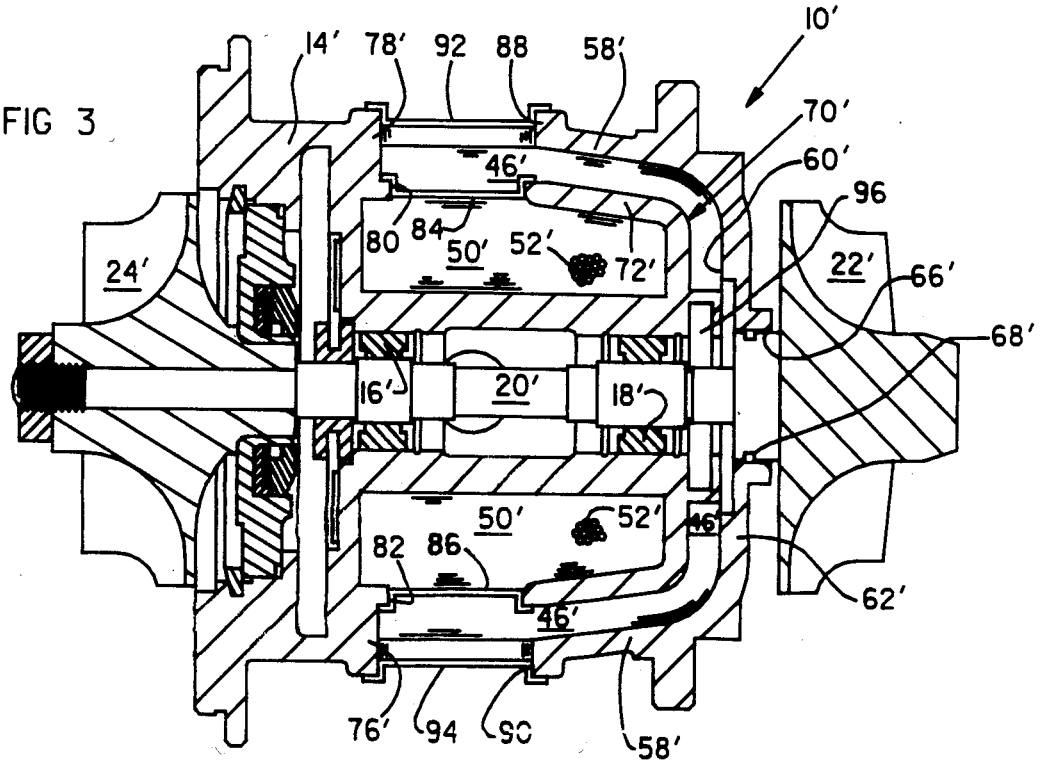
FIG. 3 is a fragmentary cross-sectional view similar to FIG. 2, and depicting an alternative embodiment of the invention.

FIG. 3 depicts an alternative embodiment of the invention wherein a very large part of the heat transfer path of support sections 76, 78 of the first embodiment is eliminated. In order to promote continuity of description of the invention while comparing and contrasting the two depicted embodiments, reference numerals previously used are employed with a prime added in FIG. 3 to refer to structurally or functionally equivalent features. The advantageous elimination in the alternative embodiment of heat transfer pathways to bearing 18' is effected by having the radially extending support sections 76' and 78' circumferentially discontinuous. In other words, the wall 72' of bearing carrier 70' defines ports 80, 82 opening from cavity 50' to cavity 46'. These ports are closed by plug members 84, 86. Outwardly of plugs 84, 86, the wall 58' defines ports 88, 90, aligning therewith and of sufficient diameter to freely pass the plugs 84, 86. The outer ports 88, 90 are similarly closed by plugs 94, 94. Consequently, while the support section 74' (not illustrated) remains unchanged, the radially extending heat conducting path of sections 76, 78 is considerably reduced in comparison with the first embodiment. It will be seen that support sections 76', 78' are in fact merely radially extending bosses protruding toward bearing carrier portion 70.

In addition to the above, it will be seen that the bearing carrier portion 70' defines a circumferentially continuous recess 96 opening radially outwardly of shaft 20' and immediately adjacent axially to bearing 18'. The recess 96 is disposed between bearing 18' and surface 60' of wall 62' to receive oil flung radially outward by spinning motion of shaft 20'. In order to drain oil from recess 96 the bearing carrier portion defines a conduit (not shown) opening downwardly therefrom into oil drain gallery 46. As a result of the reces 96, the surface 60' of wall 62' is maintained virtually dry of oil during operation of turbocharger 10'. Recognizing that the wall 62' is exposed on its surface opposite to surface 60' to hot exhaust gasses or to heat conducted through a very short heat transfer path, the Applicant believes it desirable to minimize contact of the oil with very hot surfaces, such as surface 60', in order to minimize thermal breakdown or coking of the oil on such surfaces.

An advantage of the present invention in addition to the elimination of engine coolant plumbing to the turbocharger and attendant simplified installation and maintenance, is its particular utility with air-cooled engines. These engines have no liquid engine coolant which could be used in the conventional way to cool a turbocharger. Consequently, turbocharger applications to these engines have conventionally involved many problems. The present invention is believed to provide a substantially complete solution to this difficult turbocharger application problem.

While the present invention has been depicted and described with reference to two preferred embodiments of the invention, no limitation upon the invention is implied by such reference, and none is to be inferred. The invention is intended to be limited only by the spirit and scope of the appended claims, which claims also provide a further disclosure of and definition of the invention.

I claim:

1. Turbocharger apparatus comprising a housing including a center housing portion spacing apart a compressor housing portion and a turbine housing portion, said center housing portion journaling an elongate shaft extending between said compressor housing portion and said turbine housing portion, a bearing having an axial dimension and supported by said center housing portion adjacent said turbine housing portion, said bearing rotatably supporting said shaft, a turbine rotor drivingly connecting to said shaft and rotatable within said turbine housing portion, a comprssor rotor drivingly connecting to said shaft and rotatable within said compressor housing portion, each of said compressor housing portion and said turbine housing portion defining a respective inlet and a respective outlet communicating via a respective flow path for flow of combustion products and charge air respectively over said turbine rotor and said compressor rotor, said center housing portion defining a radially outer axially and circumferentially extending annular wall extending between said compressor housing portion and said turbine housing portion, said center housing portion further defining a bearing carrier portion interiorly of and spaced radially from said radially outer annular wall and extending between said compressor housing portion and said turbine housing portion to support said bearing, said center housing portion further defining at least one radially extending connecting portion supportingly extending between said radially outer wall and said bearing carrier portion, each said at least one connecting portion being disposed substantially entirely axially toward said compressor housing portion with respect to a radially extending plane transverse to said shaft and intermediate the axial dimension of said bearing, said bearing carrier portion defining a cavity proximate to but spaced from said bearing, a mass of material disposed within said cavity and selected to undergo a molecular change of phase with attendant absorption of heat at a selected temperature.

2. The invention of claim 1 wherein a first of said at least one connecting portions defines a passage extending from a lubricant inlet to said bearing, said bearing carrier portion and said radially outer wall defining a lubricant drain chamber extending from said bearing to a lubricant outlet.

3. The invention of claim 1 wherein a second of said at least one connecting portions defines a passage extending outwardly from said cavity to open outwardly on said radially outer wall.

4. The invention of claim 2 wherein said bearing carier portion defines a first passage opening outwardly from said cavity to said lubricant drain chamber, said radially outer wall defining a second passage aligning with said first passage and extending outwardly from said lubricant drain chamber to open on said radially outer wall.

5. The invention of claim 4 wherein a first plug member is sealingly received in said first passage, said first plug member having an outer dimension smaller than said second passage to pass freely therethrough, a second plug member being sealingly disposed in said second passage.

6. Turbocharger apparatus comprising a center housing means for spacing apart respective compressor housing portions and journaling an elongate shaft extending between said housing portions, a compressor rotor and a turbine rotor each drivingly connected to said shaft at opposite ends thereof and rotatable within respective ones of said housing portions, an axially elongate bearing carred by said center housing means proximate to said turbine housing portion and rotatably supporting said shaft, said shaft defining a first conductive heat transfer path extending from said turbine rotor to said bearing, said housing including means for defining a singular second U-shaped conductive heat transfer path extending from said turbine housing portion to said bearing, said second heat transfer path including a radially outer wall portion of said center housing means which at a transverse radial plane disposed axially within the axial dimension of said bearing defines a first radially outer annular leg of said second heat transfer path wherein conductive heat transfer extends axially away from said turbine housing portion through said radial plane, and said second heat transfer path also including a radially inner wall portion of said center housing means defining a second radially inner annular leg of said second heat transfer path wherein conductive heat transfer extends axially from said radial plane toward said turbine housing portion and said bearing, said second leg being defined in part by a material selected to undergo a molecular change of phase at a determined temperature with attendant absorption of heat.

7. The invention of claim 6 wherein said means for defining said singular heat transfer path includes a bearing carrier portion disposed centrally of said center housing portion, said bearing carrier portion defining a cavity circumscribing said shaft and spaced radially outwardly thereof, said mass of material selected to undergo a phase change at a determined temperature being disposed within said cavity.

8. The invention of claim 7 wherein said first annular radially outer heat transfer leg is defined by a radially outer axially and circumferentially extending wall defining said wall portion and extending axially from said turbine housing portion to said compressor housing portion.

9. The invention of claim 8 wherein said second conductive heat transfer path includes at least one radially extending support portion connecting said bearing carrier portion with said radially outer wall.

10. The invention of claim 9 wherein said at least one radially extending support portion is substantially entirely disposed axially toward said compressor housing portion with respect to said transverse radial plane.

11. The invention of claim 9 wherein said at least one radially extending support portion includes a passage extending from an oil inlet on said center housing means to said bearing.

12. The invention of claim 9 wherein said at least one radially extending support portion includes an opening extending from said cavity and said mass of phase change material to open outwardly on said center housing means.

13. The invention of claim 12 further including a plug member sealingly received in said opening.

14. The invention of claim 11 wherein said bearing carrier portion defines a first port opening radially outwardly from said cavity, a first plug member sealingly received in said first port, said radially outer wall defining a second port aligning with said first port, and a second plug member sealingly received in said second port.

15. The invention of claim 14 wherein said first plug member defines a certain outer diameter, said second port defining a determined inner diameter greater than said certain diameter, whereby said first plug member is passable through said second port to sealingly engage in said first port.

16. Turbocharger apparatus comprising a housing journaling an elongate shaft, a turbine rotor drivingly carried at one end of said shaft, a compressor rotor drivingly carried at the opposite end of said shaft, an elongate bearing member carried by said housing and rotatably supporting said shaft adjacent said turbine rotor, said housing defining:

(a) a first radially outer cavity extending radially outwardly from said shaft adjacent said turbine rotor but spaced thereform toward said compressor rotor, said first cavity defining a radially outer dimension, said first cavity also extending axially substantially at said radially outer dimension from adjacent said turbine rotor toward but short of said compressor rotor, said first cavity being substantially circumferentially continuous radially outwardly of said shaft from adjacent said turbine rotor axially at least to a transverse radial plane disposed axially in radial congruence with said bearing member at the end of the latter disposed toward said compressor rotor;

(b) a second radially inner cavity spaced radially outwardly of said shaft and said bearing, and spaced radially inwardly of said radially outer first cavity, and a mass of material disposed within said second cavity, said material being selected to undergo a molecular change of phase with attendant absorption of heat at a selected temperature.

17. The invention of claim 16 wherein said first cavity is defined by the cooperation of a first radially outer annular wall defined by said housing and extending axially and circumferentially between said compressor rotor and said turbine rotor, and a second radially inner wall part of a bearing carrier portion substantially coaxial with said radially outer wall, said second radially inner wall circumscribing said shaft and defining a radially inner surface which radially outwardly bounds said second radially inner cavity.

18. The invention of claim 17 wherein said housing defines at least one radially extending connecting portion supportingly interconnecting said radially outer wall and said bearing carrier portion, each of said at least one connecting portions being disposed axially substantially entirely toward said compressor rotor with respect to said transverse radial plane.

19. The invention of claim 17 wherein said housing further defines a passage opening outwardly from said radially inner second cavity.

20. The invention of claim 19 further including a radially outer first plug member sealingly received in said passage and radially outwardly bounding said first cavity, a radially inner second plug member also sealingly received in said passage and both bounding said first cavity radially inwardly while bounding said second cavity radially outwardly thereof.

21. Turbocharger apparatus comprising:

a housing defining a center housing porton axially spacing apart respective turbine housing and compressor housing portions, said center housing carrying a bearing member disposed adjacent to said turbine housing portion, each of said turbine housing portion and said compressor housing portion defining a respective inlet and outlet communicating via a respective flow path for flow therethrough of combustion products and charge air, respectively;

an elongate shaft rotatably received in said bearing member and extending axially between said compressor housing portion and said turbine housing portion;

means for providing a flow of liquid lubricant to said bearing;

a compressor rotor rotatably received in said flow path of said compressor housing portion and drivingly connecting with said shaft;

a turbine rotor also drivingly connecting with said shaft and rotatable in the respective flow path of said turbine housing portion;

said housing further defining a radially extending wall between said bearing member and said turbine rotor, said wall having an axially disposed face confronting said bearing member, said radially extending wall including an aperture rotatably receiving said shaft, and said shaft and said radially extending wall defining cooperating sealing means for impeding fluid flow therebetween;

said housing further defining a circumferentially continuous annular recess between said bearing member and said axially disposed face of said wall, and means for draining from said recess liquid lubricant escaping axially from said bearing along said shaft and which is flung radially outwardly into said recess by spinning motion of said shaft, whereby said axially disposed face of said radially extending wall is maintained substantially dry of liquid lubricant during operation of said turbocharger.

22. Turbocharger apparatus comprising a housing rotatably receiving both a shaft and a turbine rotor which is drivingly connected on said shaft;

said housing defining an exhaust gas inlet, an exhaust gas outlet, and a flow path extending between said inlet and said outlet traversing said turbine rotor;

a bearing member carried by said housing and journaling said shaft most proximate to but spaced axially from said turbine rotor;

said housing defining a radially extending transverse wall interposed between said bearing and said turbine rotor;

sealing means cooperating with said shaft and said radially extending wall to inhibit fluid flow therebetween;

means for providing a flow of liquid lubricant to said bearing member for axial outward flow therefrom; and said housing defining a radially extending annular recess circumscribing said shaft and opening radially inwardly theretoward and being disposed immediately adjacent said bearing member between the latter and said radially extending wall to receive liquid lubricant exiting said bearing member axially which is flung radially outwardly by rotary motion of said shaft.

* * * * *